US005117787A

United States Patent [19]

Speil

[11] Patent Number: 5,117,787

[45] Date of Patent: Jun. 2, 1992

[54] SELF-ADJUSTING HYDRAULIC VALVE TAPPET

[75] Inventor: Walter Speil, Ingolstadt, Fed. Rep. of Germany

[73] Assignee: INA Walzlager Schaeffler KG, Fed. Rep. of Germany

[21] Appl. No.: 741,644

[22] Filed: Aug. 7, 1991

[30] Foreign Application Priority Data

Oct. 1, 1990 [DE] Fed. Rep. of Germany ..... 4030987

[51] Int. Cl.[5] ..... F01L 1/14; F01L 1/24

[52] U.S. Cl. ..... 123/90.55; 123/90.52; 74/569

[58] Field of Search ..... 123/90.48, 90.52, 90.55, 123/90.56, 90.57; 74/569

[56] References Cited

U.S. PATENT DOCUMENTS

| | | | |
|---|---|---|---|
| 4,688,525 | 8/1987 | Nakamura | 123/90.55 |
| 4,787,347 | 11/1988 | Schaeffler | 123/90.55 |
| 4,800,851 | 1/1989 | Hertrich et al. | 123/90.55 |
| 4,867,114 | 9/1989 | Schaeffler | 123/90.55 |
| 4,945,871 | 8/1990 | Tsuruta | 123/90.55 |
| 4,976,230 | 12/1990 | Voigt | 123/90.55 |
| 5,018,488 | 5/1991 | Randle | 123/90.55 |

*Primary Examiner*—E. Rollins Cross
*Assistant Examiner*—Weilun Lo
*Attorney, Agent, or Firm*—Bierman and Muserlian

[57] ABSTRACT

A self-adjusting hydraulic valve tappet arranged in a guide bore of a cylinder head of an internal combustion engine and comprising a cup-shaped housing which surrounds a hollow cylindrical wall which is closed at one end by a bottom against which a control cam bears on the outside, the housing comprising a cylindrical guide sleeve which is concentric with the hollow cylindrical wall and which at its end facing away from the bottom opens into the center of a disc member which at its outer periphery merges into the hollow cylindrical wall of the housing, the actual hydraulic clearance compensation element being guided longitudinally displaceably in the guide sleeve and an annular oil reservoir being defined by the hollow cylindrical wall, the cylindrical guide sleeve, the bottom and the disc member and supplied with oil from the lubricating oil circuit of the internal combustion engine via a bore arranged in the hollow cylindrical wall, the annular oil reservoir being provided with an air vent bore in one of its delimiting walls, characterized in that at one point of a wall delimiting the oil reservoir and which is in sliding contact with an adjacent structural component at least during the phase in which the base circle of the control cam bears against the bottom of the valve tappet, a bore is provided which opens into the sliding gap defined by these components.

8 Claims, 3 Drawing Sheets

SELF-ADJUSTING HYDRAULIC VALVE TAPPET

STATE OF THE ART

Figure 1:
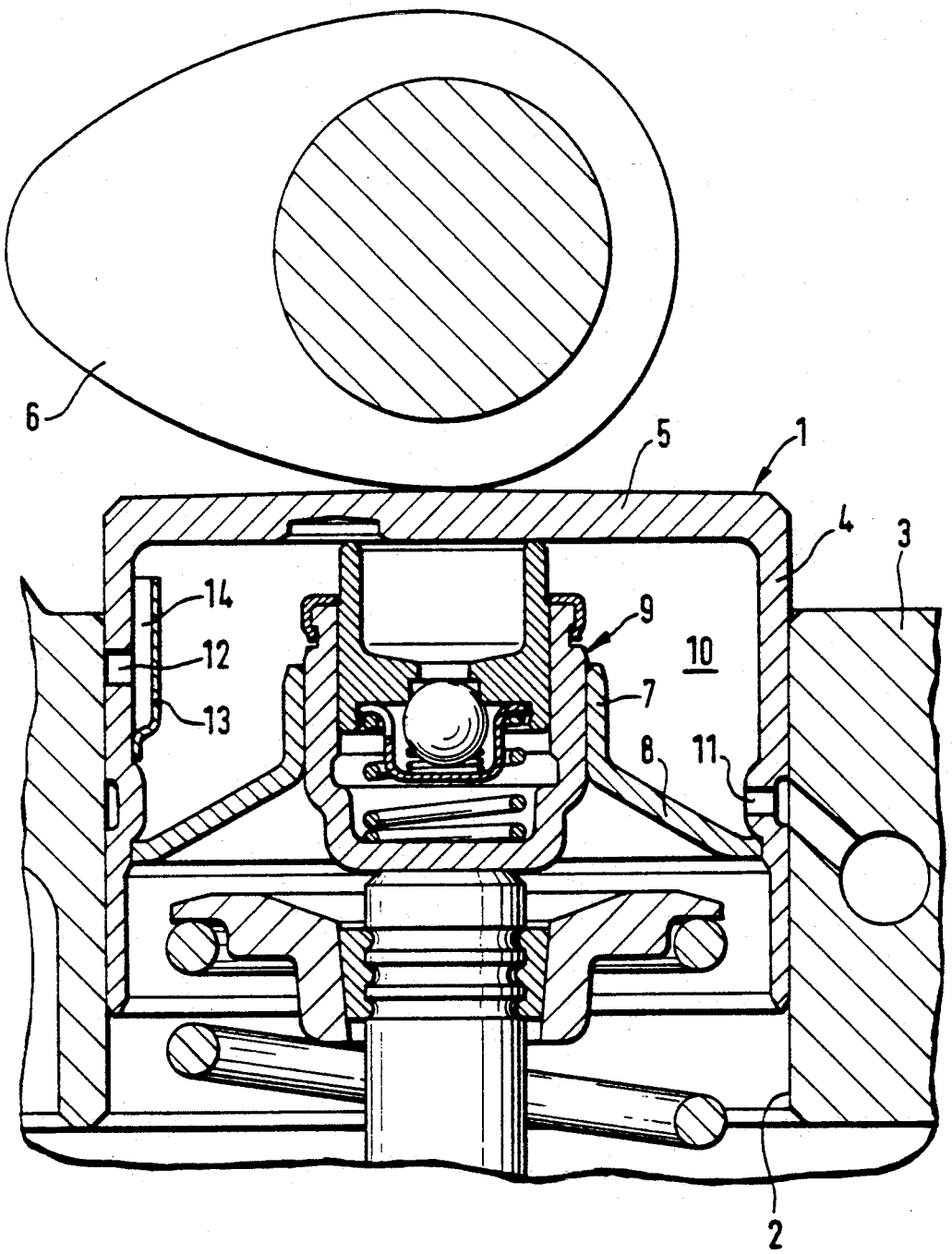

Self-adjusting hydraulic valve tappets arranged in a guide bore of a cylinder head of an internal combustion engine and comprising a cup-shaped housing which surrounds a hollow cylindrical wall which is closed at one end by a bottom against which a control cam bears on the outside, the housing comprising a cylindrical guide sleeve which is concentric with the hollow cylindrical wall and which at its end facing away from the bottom opens into the center of a disc member which at its outer periphery merges into the hollow cylindrical wall of the housing, the actual hydraulic clearance compensation element being guided longitudinally displaceably in the guide sleeve and an annular oil reservoir being defined by the hollow cylindrical wall, the cylindrical guide sleeve, the bottom and the disc member and supplied with oil from the lubricating oil circuit of the internal combustion engine via a bore arranged in the hollow cylindrical wall, the annular oil reservoir being provided with an air vent bore in one of its delimiting walls are known.

In such and similar hydraulic valve tappets, it is already known to provide air vent bores leading from the oil reservoir to the outside. As a rule, these bores are given an extremely small cross-section to prevent a large quantity of oil from escaping through them in addition to the air. Oil which escapes from the reservoir has to be replaced by oil reflowing from the oil circuit which, however, is accompanied by a simultaneous penetration of dirt particles and air into the oil reservoir.

It has been proposed, for example, to arrange a bore leading from the oil reservoir to the outside so that it is covered by the guide bore of the housing during the valve lift phase and exposed during the phase in which the base circle of the control cam bears against the bottom of the valve tappet. This resulted in a considerable amount of oil escaping through this bore during the base circle phase. If, to avoid this, the bore had been made very small, the danger would have existed that this narrow bore would be very soon obstructed with dirt particles (GB-PS 1,064,338).

OBJECTS OF THE INVENTION

It is an object of the invention to provide a tappet of the species in question with an air vent having a comparatively large cross-section so that there is no danger of its becoming clogged but with which it is still assured that oil escape remains confined within narrow limits.

This and other objects and advantages of the invention will become obvious from the following detailed description.

THE INVENTION

The self-adjusting hydraulic valve tappet of the invention arranged in a guide bore of a cylinder head of an internal combustion engine and comprising a cup-shaped housing which surrounds a hollow cylindrical wall which is closed at one end by a bottom against which a control cam bears on the outside, the housing comprising a cylindrical guide sleeve which is concentric with the hollow cylindrical wall and which at its end facing away from the bottom opens into the center of a disc member which at its outer periphery merges into the hollow cylindrical wall of the housing, the actual hydraulic clearance compensation element being guided longitudinally displaceably in the guide sleeve and an annular oil reservoir being defined by the hollow cylindrical wall, the cylindrical guide sleeve, the bottom and the disc member and supplied with oil from the lubricating oil circuit of the internal combustion engine via a bore arranged in the hollow cylindrical wall, the annular oil reservoir being provided with an air vent bore in one of its delimiting walls, is characterized in that at one point of a wall delimiting the oil reservoir and which is in sliding contact with an adjacent structural component at least during the phase in which the base circle of the control cam bears against the bottom of the valve tappet, a bore is provided which opens into the sliding gap defined by these components.

At one point of a wall delimiting the oil reservoir and which is in sliding contact with an adjacent structural component at least during the phase in which the base circle of the control cam bears against the bottom of the valve tappet, a bore opening into the sliding gap defined by these components is provided. In this way, with the help of the sliding gap which acts as a throttle arranged downstream of the bore and which can have a relatively large cross-section, it is achieved that indeed the air contained in the pressure chamber can escape freely, but only an extremely limited amount of oil is able to exit due to its higher viscosity.

To achieve this purpose, the bore can be provided, for example, in the hollow cylindrical wall and open into the sliding gap between this wall and the guide bore of the cylinder head. However, it is also possible to arrange the bore in the wall of the cylindrical guide sleeve and have it open into the sliding gap between this and the hydraulic clearance compensation element. It is desirable in all cases to arrange the bore at a point of the oil reservoir located near the bottom. This is not always readily possible because, if the bore is provided in the hollow cylindrical wall of the cup tappet, it can get situated outside the sliding gap between this wall and the guide bore of the cylinder head during the base circle phase. In this case, the bore has to be arranged at a greater distance from the bottom of the tappet. In order to still assure that the air which collects in the upper region near the bottom during the base circle phase in which the tappet is at rest is dependably exhausted, a canal can be provided inside the oil reservoir to connect with the bore and end near the bottom.

This can be done in a simple manner by providing that the bore be overlapped at the inner surface of the hollow cylindrical wall by a fluted member which extends in the longitudinal direction and which is closed at its end away from the bottom and open at its upper end near the bottom.

A particularly suitable construction results if the cylindrical guide sleeve and the disc member are made as a one-piece component on whose outer edge a cylindrical collar is integrally formed which bears closely against the inner surface of the hollow cylindrical wall, but is spaced from the wall at the peripheral points where the oil supply bore and the air vent bore are provided in the wall and thus forms a longitudinal canal opening in the neighborhood of the bottom. Such a component can be made either as a drawn sheet metal part or an injection molded part made of polymeric material.

Figure 2:
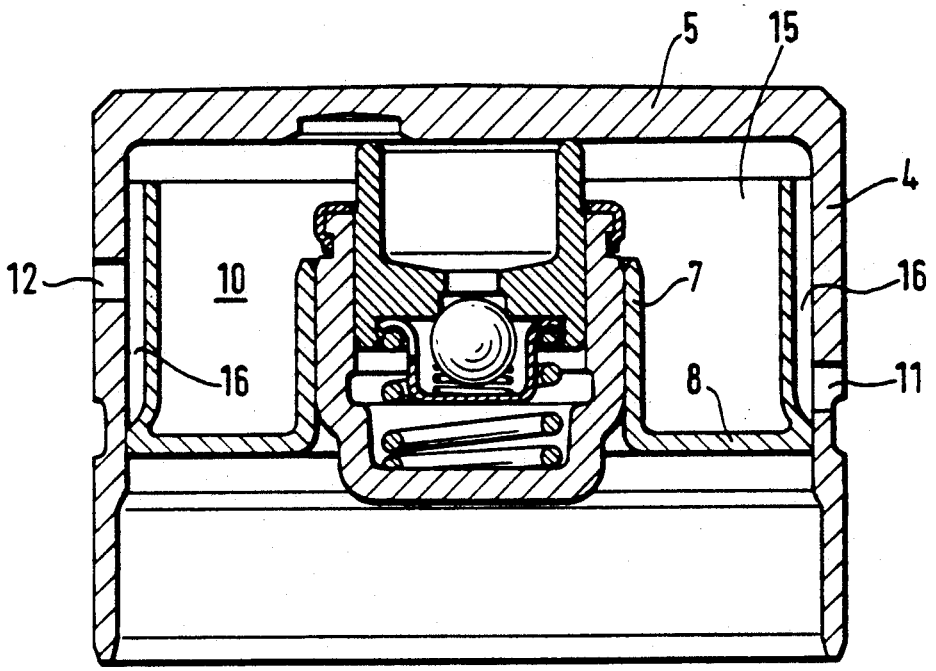
Figure 3:
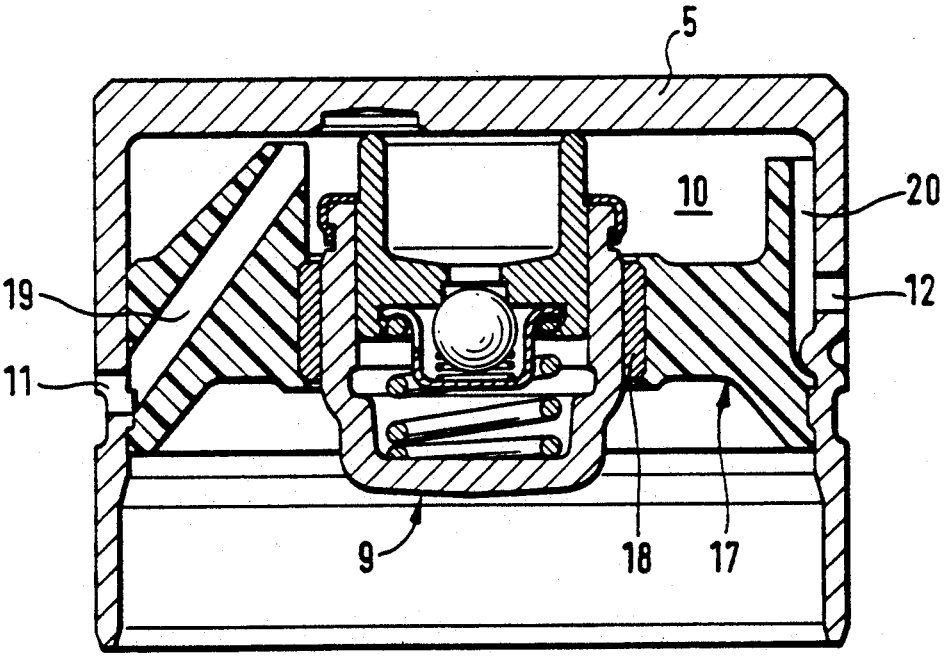
Figure 4:
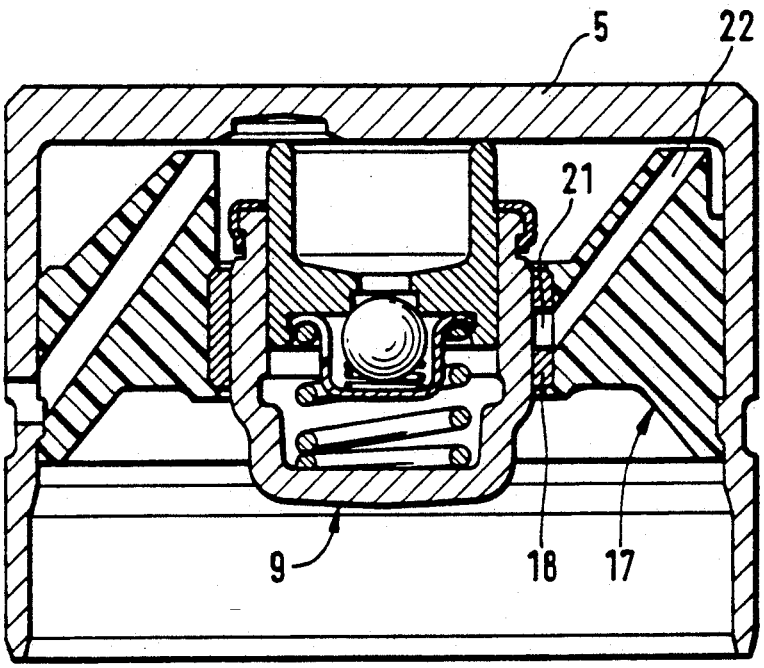

Referring now to the drawings:

FIG. 1 is a longitudinal cross-section through a valve tappet in its installed condition between a control cam and the valve stem, FIGS. 2 to 4 are longitudinal cross-sections through different embodiments of hydraulic valve tappets of the invention.

FIG. 1 shows a hydraulic valve tappet 1 which is arranged in a guide bore 2 of the cylinder head 3 of an internal combustion engine and comprises a housing surrounding a hollow cylindrical wall 4 which is closed at its upper end by a bottom 5 against which the control cam 6 bears on the outside. Inside the cup-shaped tappet, a cylindrical guide sleeve 7 is provided which is concentric with the hollow cylindrical wall 4 and which at its end facing away from the bottom 5, opens into the center of a disc member 8 which at its outer periphery merges into the hollow cylindrical wall 4 of the housing. The actual hydraulic clearance compensation element 9 is longitudinally displaceably guided in the guide sleeve 7. The hollow cylindrical wall 4, the cylindrical guide sleeve 7, the bottom 5 and the disc member 8, as also a part of the hydraulic clearance compensation element 9, together define an annular oil reservoir 10 which is supplied with oil from the lubricating oil circuit of the internal combustion engine via a bore 11 arranged in the hollow cylindrical wall 4. Further, an air vent bore 12 is provided in the hollow cylindrical wall 4 and situated preferably diametrically opposite the oil supply bore 11 to open into the sliding gap existing between the hollow cylindrical wall 4 and the guide bore 2. The air vent bore 12 is situated at such a location so that it is in sliding contact with the guide bore 2, particularly also during the phase in which the base circle of the control cam 6 bears against the bottom 5 of the valve tappet 1.

To assure that the air which collects near the bottom 5 during the base circle phase can be dependably exhausted, although the air vent bore 12 is situated at a distance from the bottom, a shaped part 13 is fixed inside the oil reservoir 10 to overlap the air vent bore 12 and form a canal 14 opening in the neighborhood of the bottom.

The embodiment represented in FIG. 2 differs from the embodiment of FIG. 1 essentially in that the cylindrial guide sleeve 7 and the disc member 8 are made as a one-piece component on whose outer edge a cylindrical collar 15 is integrally formed which bears closely against the inner surface of the hollow cylindrical wall 4 but is spaced from the wall at the peripheral points where the oil supply bore 11 and the air vent bore 12 are provided in the wall 4 and thus forms a longitudinal canal 16 ending in the neighborhood of the bottom.

In the embodiments of FIGS. 3 and 4, a component 17 made of polymeric material forming both the cylindrical guide sleeve and the disc member is inserted into the tappet. The guiding of the hydraulic clearance compensation element 9 in this component 17 is effected by an inserted metallic guide bushing 18. In the embodiment of FIG. 3, the component 17 is provided with a canal 19 which connects with the oil supply bore 11 and extends upwards at a slant to end in the upper region of the annular oil reservoir 10 and thus prevents an emptying of the oil reservoir in the standstill period. In the region of the air vent bore 12, the component 17 forms a canal 20 opening in the direction of the bottom 5.

The embodiment of FIG. 4 differs from the preceding embodiment only in that the air vent bore 21 is provided in the guide bushing 18 and therefore opens into the sliding gap existing between this guide bushing 18 and the hydraulic clearance compensation element 9. A canal 22 formed in the component 17 and extending towards the bottom 5 connects with the air vent bore 21 provided in the guide bushing 18.

Various modifications of the valve tappet of the invention may be made without departing from the spirit or scope thereof and it is to be understood that the invention is intended to be limited only as defined in the appended claims.

What I claim is:

1. A self-adjusting hydraulic valve tappet arranged in a guide bore of a cylinder head of an internal combustion engine and comprising a cup-shaped housing which surrounds a hollow cylindrical wall which is closed at one end by a bottom against which a control cam bears on the outside, the housing comprising a cylindrical guide sleeve which is concentric with the hollow cylindrical wall and which at its end facing away from the bottom opens into the center of a disc member which at its outer periphery merges into the hollow cylindrical wall of the housing, the actual hydraulic clearance compensation element being guided longitudinally displaceably in the guide sleeve and an annular oil reservoir being defined by the hollow cylindrical wall, the cylindrical guide sleeve, the bottom and the disc member and supplied with oil from the lubricating oil circuit of the internal combustion engine via a bore arranged in the hollow cylindrical wall, the annular oil reservoir being provided with an air vent bore in one of the hollow cylindrical wall and the cylindrical guide sleeve which are respectively in sliding contact with an adjacent structural component at least during the phase in which the base circle of the control cam bears against the bottom of the valve tappet, said air vent bore opens into the sliding gap defined by these components.

2. A valve tappet of claim 1 wherein the air vent bore is provided in the hollow cylindrical wall and opens into the sliding gap between this wall and the guide bore of the cylinder head.

3. A valve tappet of claim 1 wherein the air vent bore is provided in the wall of the cylindrical guide sleeve and opens into the sliding gap between this and the hydraulic clearance compensation element.

4. A valve tappet of claim 1 wherein a canal connecting with the air vent bore and ending near the bottom is provided inside the oil reservoir.

5. A valve tappet of claim 2 wherein the air vent bore is overlapped at the inner surface of the hollow cylindrical wall by a fluted member which extends in the longitudinal direction and which is closed at its end away from the bottom and open at its upper end near the bottom.

6. A valve tappet of claim 2 wherein the cylindrical guide sleeve and the disc member are consituted by a one-piece component on whose outer edge a cylindrical collar is integrally formed which bears closely against the inner surface of the hollow cylindrical wall but is spaced from the wall at the peripheral points where the oil supply bore and the air vent bore are provided in the wall and thus forms a longitudinal canal opening in the neighborhood of the bottom.

7. A valve tappet of claim 2 wherein a single component of polymeric material constitutes both the cylindrical guide sleeve and the disc member and is inserted in a liquid-tight manner into the bore of the hollow cylindrical wall and comprises canals which connect both the oil supply bore and the air vent bore with the region of the oil reservoir located near the bottom.

8. A valve tappet of claim 3 wherein the air vent bore is connected with the region of the oil reservoir situated near the bottom via a canal provided in a component made of polymeric material which forms both the cylindrical guide sleeve and the disc member.

* * * * *